US007549181B1

(12) United States Patent
Davis et al.

(10) Patent No.: US 7,549,181 B1
(45) Date of Patent: Jun. 23, 2009

(54) TOILET LID APPARATUS

(76) Inventors: Johnny A. Davis, 3303 Sand Rd., Steens, MS (US) 39766; Debra A. Davis, 3303 Sand Rd., Steens, MS (US) 39766

( * ) Notice: Subject to any disclaimer, the term of this patent is extended or adjusted under 35 U.S.C. 154(b) by 415 days.

(21) Appl. No.: 11/466,525

(22) Filed: Aug. 23, 2006

(51) Int. Cl.
*E03D 9/02* (2006.01)

(52) U.S. Cl. ..... 4/227.1; 4/227.2; 4/227.4

(58) Field of Classification Search ..... 222/62, 222/67, 476, 477; 4/227.1, 227.4, 227.2, 4/227.6, 227.7
See application file for complete search history.

(56) References Cited

U.S. PATENT DOCUMENTS 1,322,838 A 11/1919 Sowerby
2,243,454 A 5/1941 Collinge et al.
2,520,056 A 8/1950 Pozun
3,398,862 A * 8/1968 Willis ..... 222/57
4,131,958 A * 1/1979 Dolan ..... 4/227.5
5,038,417 A * 8/1991 Bavaveas ..... 4/227.4
5,734,996 A * 4/1998 Lee ..... 4/227.3
6,651,260 B1 * 11/2003 Dodson ..... 4/227.1
7,093,738 B1 * 8/2006 Evans et al. ..... 222/205

* cited by examiner

*Primary Examiner*—Gregory L Huson
*Assistant Examiner*—Karen Younkins
(74) *Attorney, Agent, or Firm*—Crossley Patent Law; Mark Crossley

(57) ABSTRACT

A toilet lid solution apparatus which replaces a toilet reservoir lid. The apparatus stores a chosen disinfectant solution and meters the dispensing thereof with each flush. The apparatus' installation requires no special tools, knowledge or changes to the toilet or reservoir for installation.

6 Claims, 8 Drawing Sheets

TOILET LID APPARATUS

BACKGROUND OF THE INVENTION

It is desirable to provide disinfectant for a toilet. It is further desirable to provide for measured disinfectant introduction into the reservoir of the toilet, whereby reservoir water is treated, and the toilet bowl is treated upon flushing. What is needed is a replacement lid for a toilet reservoir that provides for storage and dispensing of disinfectant or other solution into the toilet water. Solution introduction should be metered per flush. Solution storage size should be sufficient to negate frequent refilling of the solution. The lid should be stand-alone such that no other items are needed for fitting a toilet reservoir. Additionally, the lid installation should require no tools or trade knowledge.

FIELD OF THE INVENTION

The toilet lid apparatus relates to toilets and more especially to a toilet lid apparatus that replaces a toilet reservoir lid and dispenses a measured quantity of desired solution into the toilet water with each flush.

DESCRIPTION OF THE PRIOR ART

Prior related art U.S. Pat. No. 2,520,056 to Pozun on Aug. 22, 1950 teaches a toilet disinfectant device. The device, however, feeds disinfectant drop by drop into the overflow pipe, and not into the reservoir, as does the present apparatus. U.S. Pat. No. 2,243,454 to Collinge et al. on May 27, 1941 teaches a dispenser for disinfectants for a toilet. The device is not offered as a lid, as is the present apparatus. U.S. Pat. No. 1,322,838 to Sowerby on Nov. 25, 1919 teaches a disinfecting device for a toilet. The device is not a replacement reservoir lid, as is the present apparatus.

While the above-described devices fulfill their respective and particular objects and requirements, they do not describe a toilet lid apparatus that provides for the advantages of the present toilet lid apparatus. In this respect, the present toilet lid apparatus substantially departs from the conventional concepts and designs of the prior art. Therefore, a need exists for an improved toilet lid apparatus that stores and dispenses a solution into toilet water.

SUMMARY OF THE INVENTION

The general purpose of the toilet lid apparatus, described subsequently in greater detail, is to provide a toilet lid apparatus which has many novel features that result in an improved toilet lid apparatus which is not anticipated, rendered obvious, suggested, or even implied by prior art, either alone or in combination thereof.

To attain this, the toilet lid apparatus comprises a toilet reservoir lid. The replacement lid apparatus is produced in an array of sizes and colors in order to match most makes and models of toilets. Preferably, the apparatus is made of plastic, polymers, and the like, in order to save the expense of porcelain. Porcelain, however, is also offered. The apparatus offers tool free installation, requiring only removal of an existing reservoir lid and subsequent replacement of that lid with the present apparatus. Additionally, the replacement lid apparatus provides for a significant quantity of disinfectant solution, so that refilling is not a frequently required task. The lid apparatus comprises a holding tank for holding a chosen disinfectant or cleaner or other desired solution. The holding tank is visually shielded beneath a hinged lid on top of the apparatus. A filler cap tops the holding tank. The hour glass float valve assembly meters a predetermined amount of the chosen solution with every toilet flush. The valve is opened and closed by the lowering and raising of the reservoir water level, respectively, with each flush.

Thus has been broadly outlined the more important features of the improved toilet apparatus so that the detailed description thereof that follows may be better understood and in order that the present contribution to the art may be better appreciated.

An object of the toilet lid apparatus is to provide measured introduction of solution into the toilet water with each flush.

Another object of the toilet lid apparatus is to replace an existing toilet reservoir lid.

A further object of the toilet lid apparatus is to provide toilet reservoir lid replacement without the need for tools.

An added object of the toilet lid apparatus is to provide toilet reservoir lid replacement without the need for specialized knowledge.

And, an object of the toilet lid apparatus is to provide for storing a substantial amount of solution within the apparatus.

Still another object of the toilet lid apparatus is to provide for easy filling with the desired solution.

Further, an object of the toilet lid apparatus is to use the water level of the toilet reservoir to assist in metering solution into the toilet water.

These together with additional objects, features and advantages of the improved toilet lid apparatus will be readily apparent to those of ordinary skill in the art upon reading the following detailed description of presently preferred, but nonetheless illustrative, embodiments of the improved toilet lid apparatus when taken in conjunction with the accompanying drawings.

In this respect, before explaining the current embodiments of the improved toilet lid apparatus in detail, it is to be understood that the toilet lid apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved toilet lid apparatus. It is therefore important that the claims be regarded as including such equivalent constructions insofar as they do not depart from the spirit and scope of the toilet lid apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 8 thereof, the principles and concepts of the toilet lid apparatus generally designated by the reference number 10 will be described.

Figure 1:
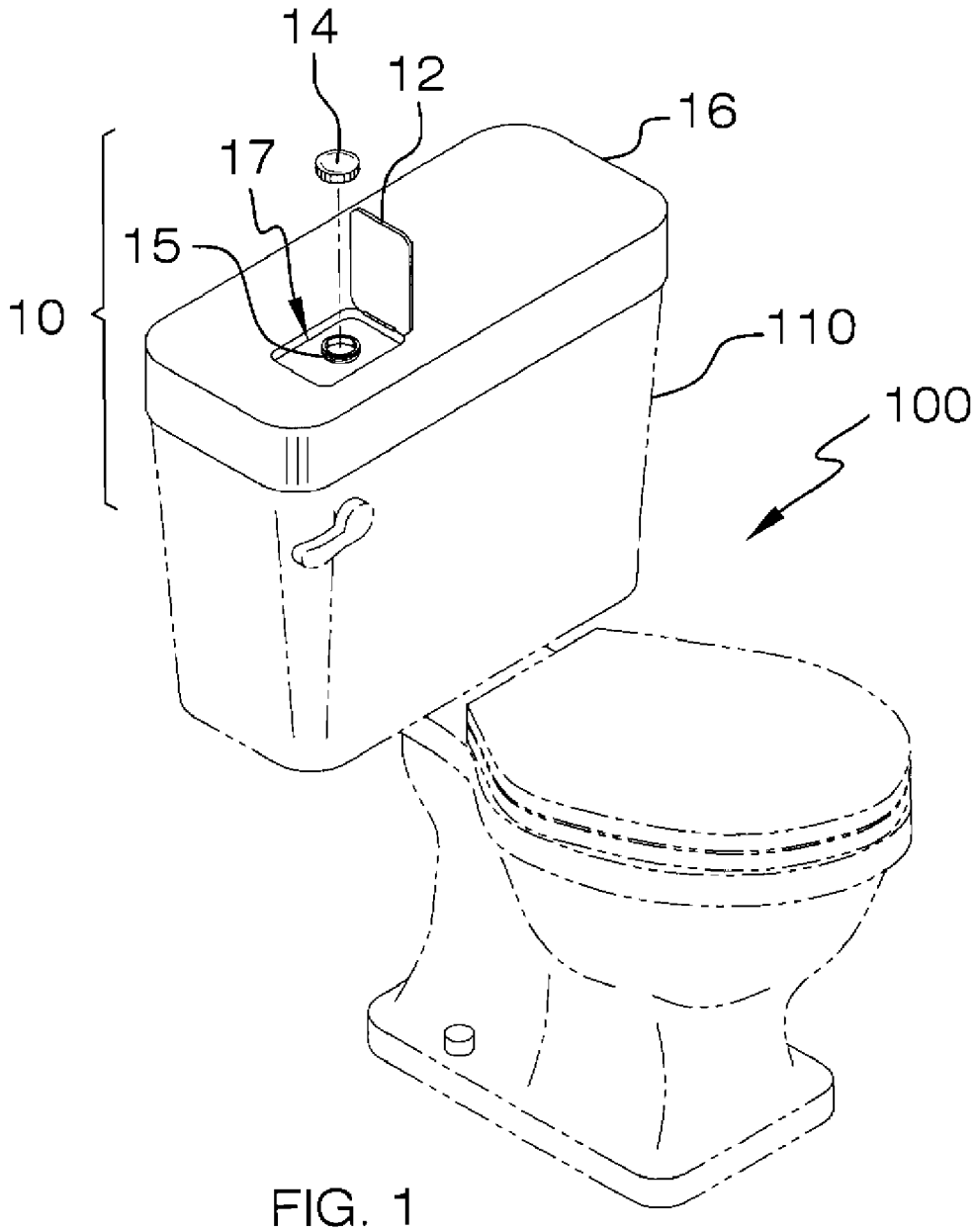
FIG. 1 is a perspective view of the apparatus fitted to a toilet reservoir.

Referring to FIG. 1, the apparatus 10 is a replacement toilet reservoir lid. The apparatus 10 partially comprises a holding tank 16. A recession 17 within the top of the holding tank 16 further comprises a threaded opening 15. The screw cap 14 selectively covers the threaded opening 15. The hinged lid 12 selectively covers the recession 17.

The toilet 100 and toilet reservoir 110 are not part of the apparatus 10.

Figure 2:
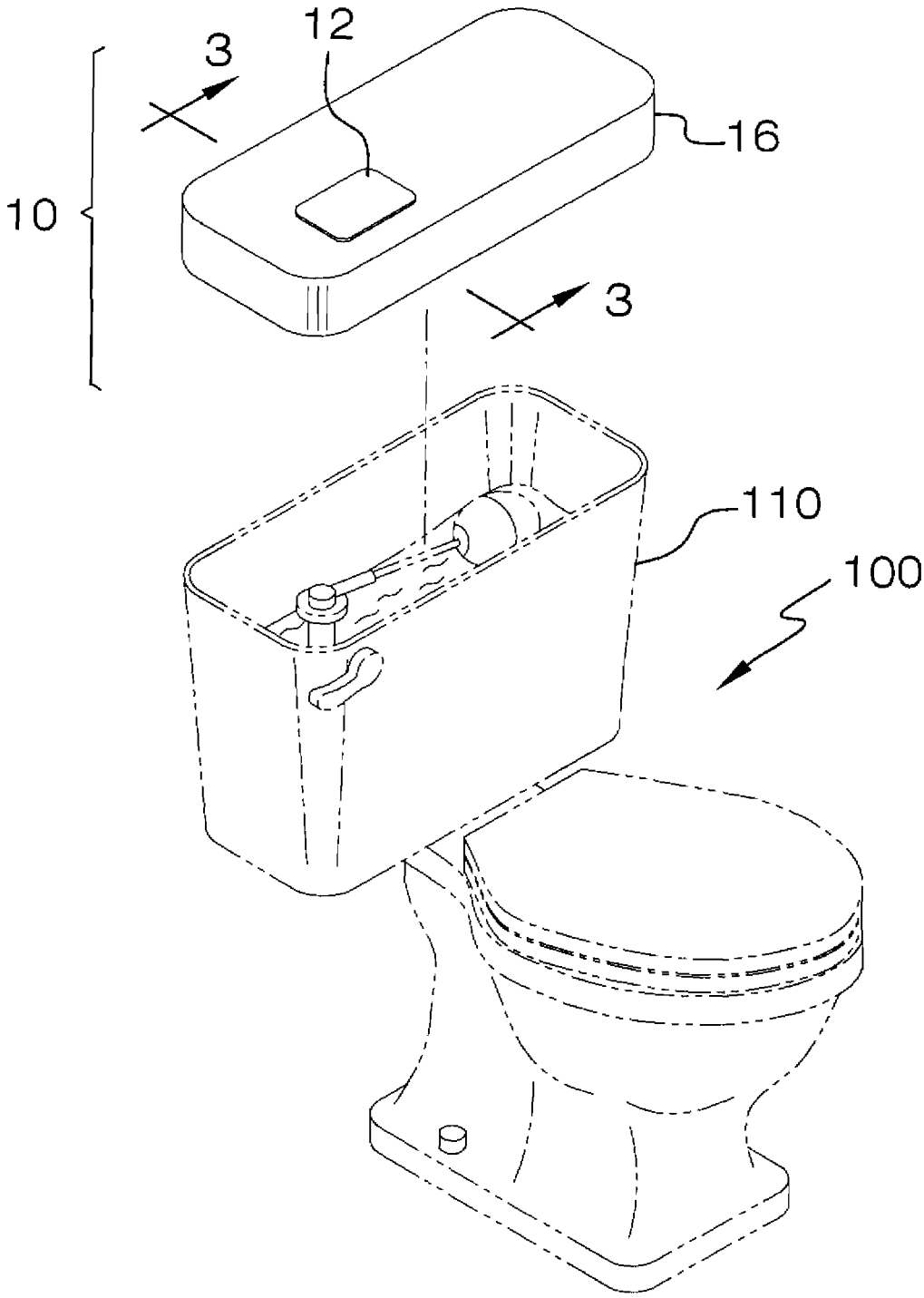
FIG. 2 is a perspective view of the apparatus removed from the toilet reservoir.

Referring to FIG. 2, the apparatus 10 holding tank 16 is sized to fit a variety of individual toilet reservoirs 110.

Figure 3:
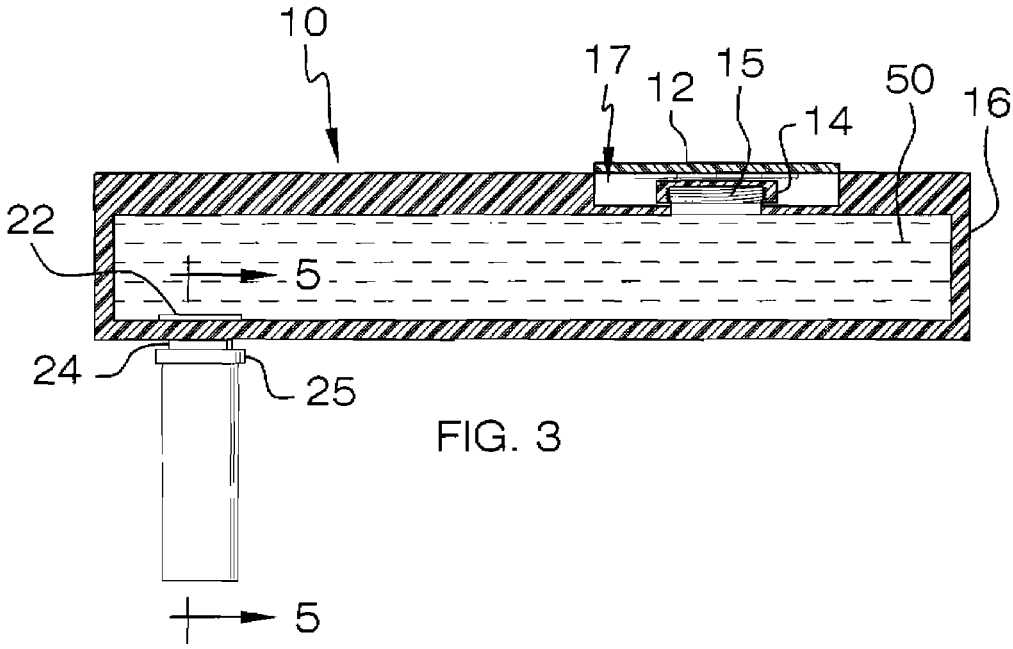
FIG. 3 is a cross sectional view of FIG. 2, taken along the line 3-3.

Referring to FIG. 3, the toilet reservoir lid apparatus 10 comprises a holding tank 16 with a hinged lid 12 on the top of the holding tank 16. A recession 17 is disposed below the hinged lid 12. The threaded opening 15 is disposed in the recession 17. The screw cap 14 selectively covers the threaded opening 15. Solution 50 is within the holding tank 16. The float valve assembly 18 is affixed to the holding tank 16 via the threaded nipple 24. The threaded nipple 24 exits the bottom of the holding tank 16. A sealing flange 22 is disposed on an upper end of the threaded nipple 24.

Figure 4:
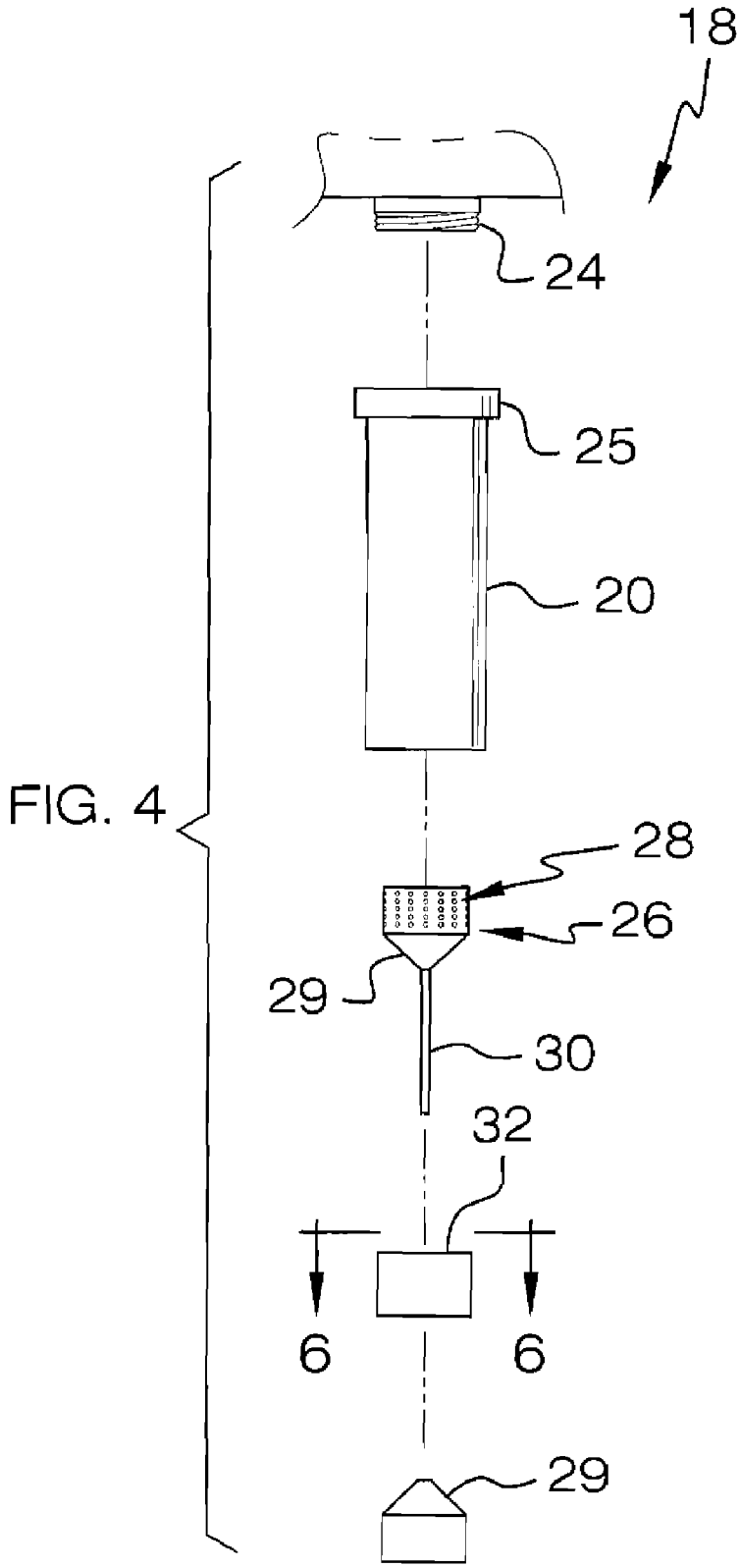
FIG. 4 is an exploded side elevation view of the float valve assembly.
Figure 5:
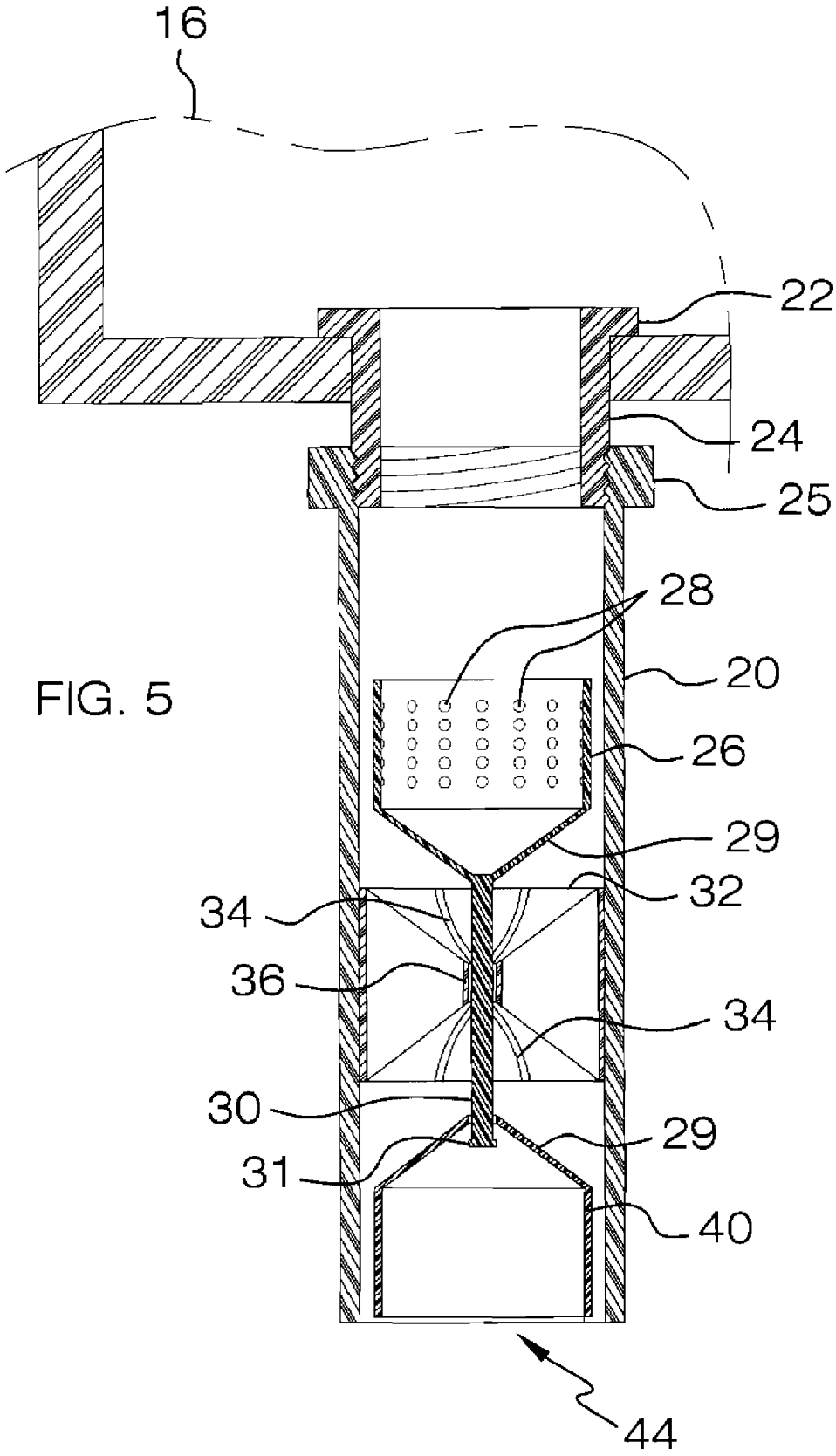
FIG. 5 is a cross sectional view of FIG. 3, taken along the line 5-5.

Referring to FIGS. 4 and 5, the float valve assembly 18 is removably affixed to the threaded nipple 24. The float valve assembly has a top end and a bottom end 18. The float valve assembly 18 is further comprised of a female flare 25 with internal female threads for attachment to the threaded nipple 24. The float valve assembly 18 comprises an open-ended hollow valve body 20. The valve body 20 is affixed to the threaded nipple 24 and extends downwardly. The stopper 32 is fitted within the valve body 20. The stopper 32 has an upper end, a lower end, and a midsection therebetween. A tapered seat 34 is disposed in the upper end of the stopper 32. A tapered seat 34 is disposed in the lower end of the stopper 32. The port 36 is disposed in the midsection of the stopper 32. The port 36 is in communication with each tapered seat 34. The stem 30 is slideably contained within the port 36. The stem 30 has a first end and a second end. A knob 31 is disposed at the second end of the stem 30. The funnel cup 26 is attached to the first end of the stem 30. The funnel cup 26 is slideably contained within the valve body 20 above the stopper 32. A downwardly facing conical member 29 is disposed on the bottom of the funnel cup 26. A plurality of cup holes 28 is disposed throughout the body of the funnel cup 26. The cup holes 28 assist in providing for the metered delivery of solution from the valve assembly 18. The float cup 40 is removably affixed over the knob 31 at the second end of the stem 30. The float cup 40 is slideably contained within the valve body 20 below the stopper 32. An upwardly facing conical member 29 is disposed on the top of the float cup 40.

Figure 6:
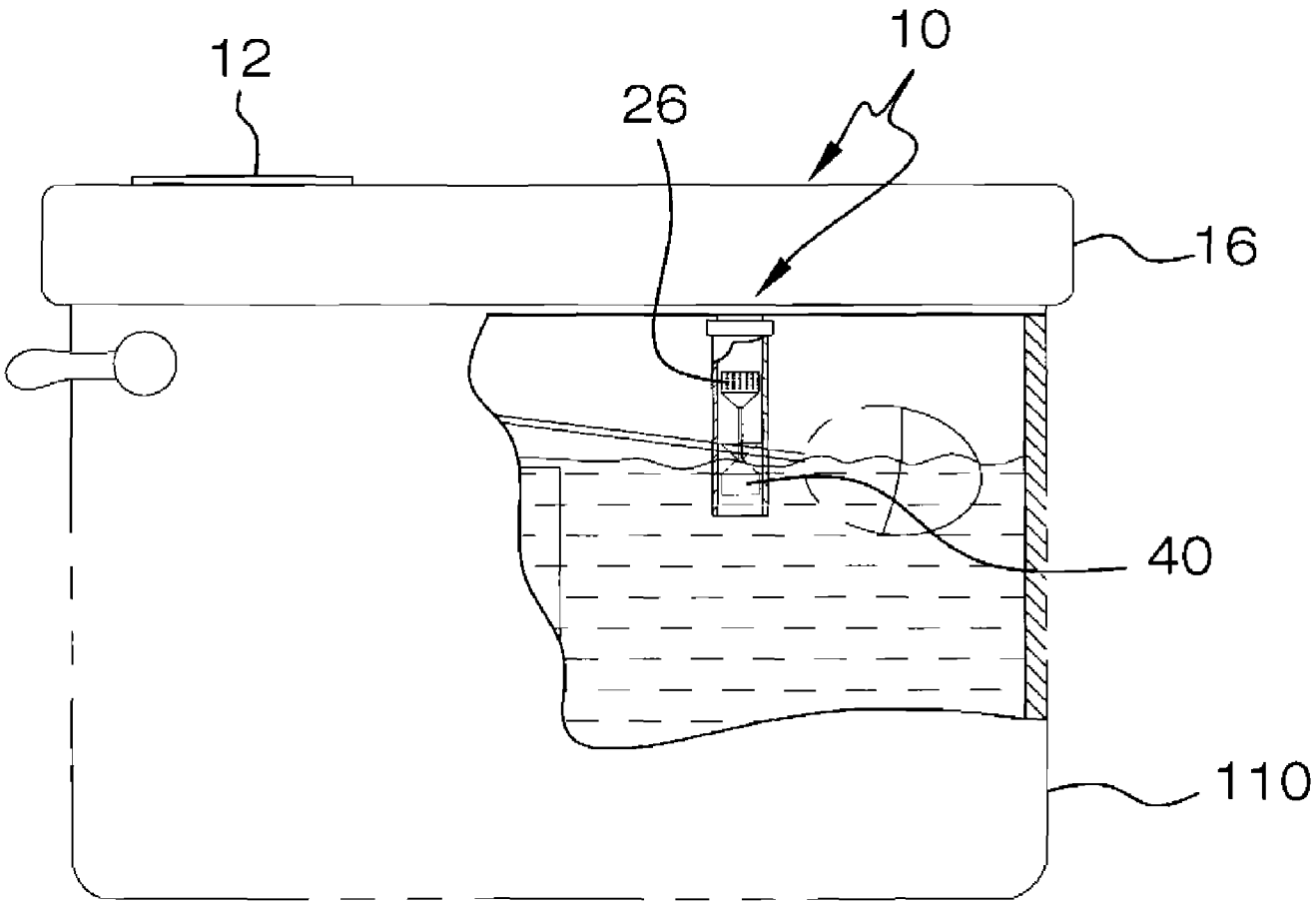
FIG. 6 is a partial cutaway view of a toilet reservoir with the apparatus installed, the reservoir water at filled level, the float valve assembly in the non-dispensing position.
Figure 7:
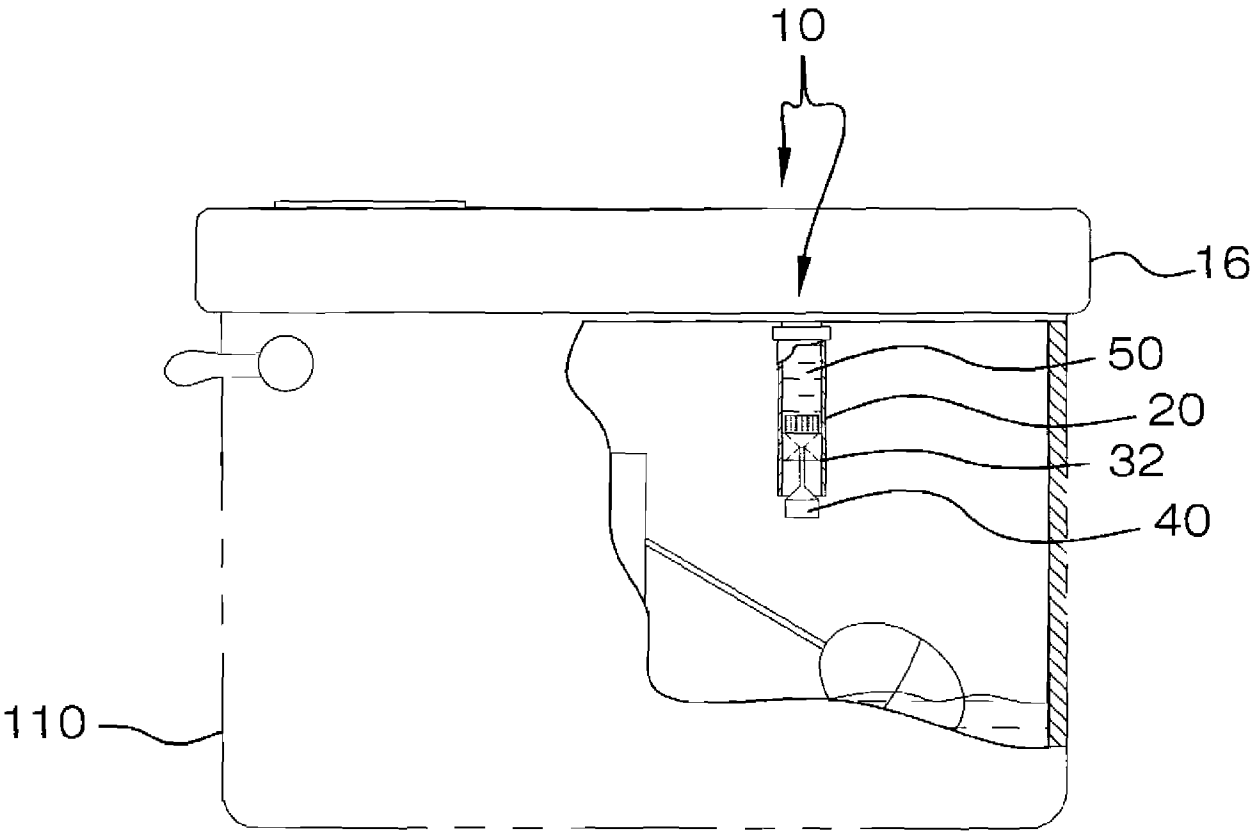
FIG. 7 is a partial cutaway view of the toilet reservoir with apparatus installed, the reservoir water at drained level.
Figure 8:
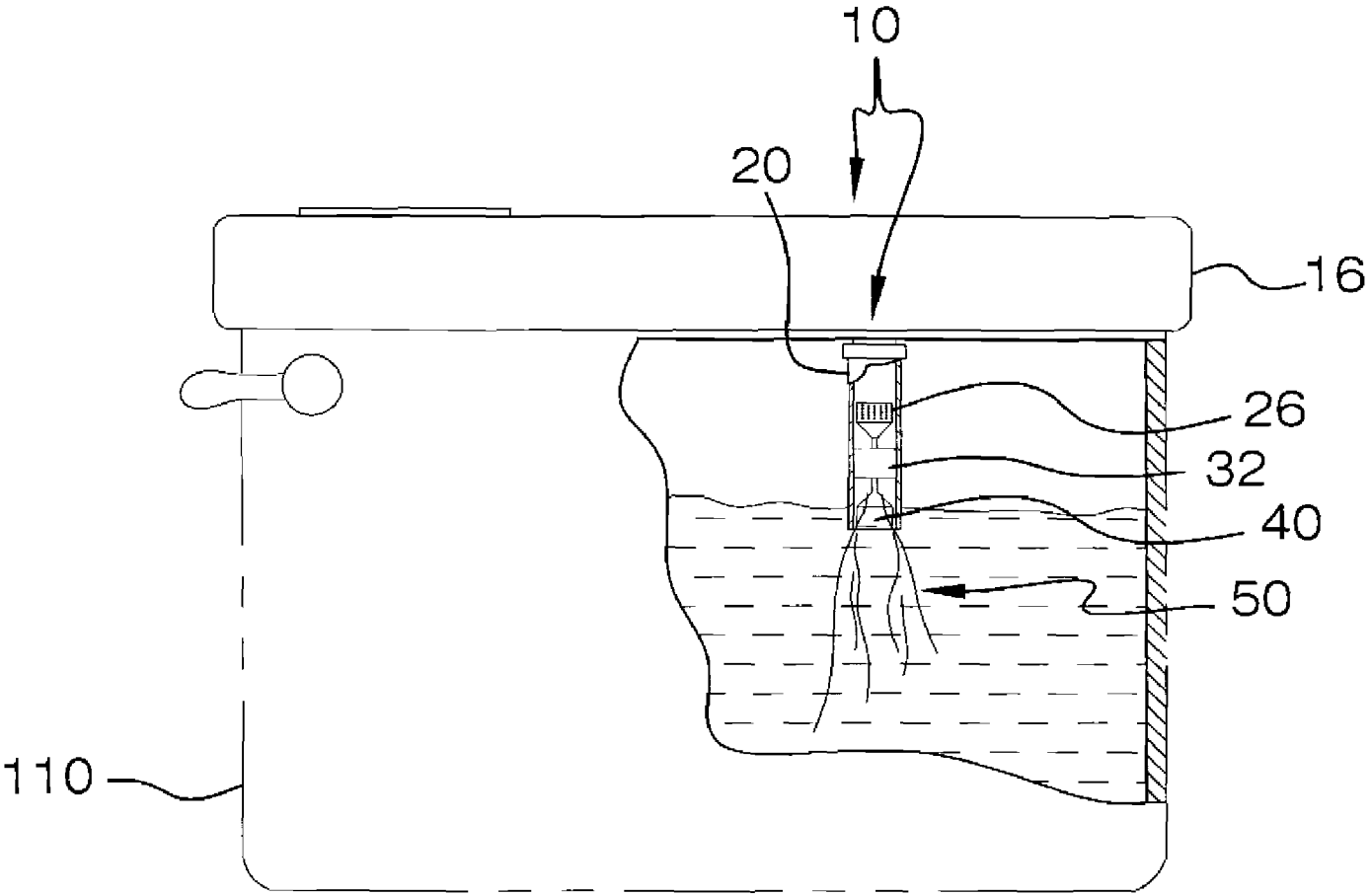
FIG. 8 is a partial cutaway view of the toilet reservoir with apparatus installed, the float valve assembly in position for solution flow.

Referring to FIGS. 6, 7, and 8, the operation of the float valve assembly 18 provides metered dispensing of the solution 50. In FIG. 6, the float cup 40 conical member 29 is seated in the lower seat 34 of the stopper 32. Flow of solution 50 from the valve body is thereby halted. The funnel cup 26 is temporarily disposed above the stopper 32. The funnel cup 26 is full of solution 50. The valve body 20 also contains solution 50, above the stopper 32. Water in the reservoir 110 forces the float cup 40 into the seat 34. In FIG. 7, the toilet 100 has just been flushed. The reservoir 110 is substantially empty. The funnel cup 26 conical member 29 is positioned against the upper seat 34 of the stopper 32. Solution 50 flow is thereby halted. The reservoir 110 is gradually filled with water. A time span occurs between a point in time when the water level reaches the float cup 40 and when the float cup 40 conical member 29 is seated against the lower seat 34 of the stopper 32, a portion of that time depicted in FIG. 8. During that time span, solution 50 flow is allowed to pass each seat 34 and through the port 36 of the stopper 32. The clearance between the funnel cup 26 and the inside of the valve body 20, along with the cup holes 28, provide the metered flow of solution 50. After expiration of the time span needed for the float cup 40 to seat against the seat 34, the flow of solution 50 is halted.

With respect to the above description then, it is to be realized that the optimum dimensional relationships for the parts of the toilet lid solution dispenser, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the toilet lid solution dispenser.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the toilet lid solution dispenser may be used.

Therefore, the foregoing is considered as illustrative only of the principles of the toilet lid solution dispenser. Further, since numerous modifications and changes will readily occur to those skilled in the art, it is not desired to limit the toilet lid solution dispenser to the exact construction and operation shown and described, and accordingly, all suitable modifications and equivalents may be resorted to, falling within the scope of the toilet lid solution dispenser.

What is claimed is:

1. A toilet reservoir lid solution dispenser apparatus, the apparatus comprising:

a holding tank of a size and shape to replace a toilet reservoir lid;

a lid on a top of the holding tank;

a recession below the lid;

a threaded opening in the recession;

a screw cap for the threaded opening;

a float valve assembly removably affixed to a bottom of the holding tank, the float valve assembly having a top end and a bottom end, the float valve assembly comprising:

a threaded flare for attachment to a threaded nipple of the holding tank;

an open-ended hollow valve body extended downwardly from the threaded nipple;

a stopper fitted within the valve body, the stopper having an upper end, a lower end, and a midsection therebetween;

a tapered seat in the upper end;

a tapered seat in the lower end;

a port in the midsection, the port in communication with each tapered seat;

a stem slideably housed within the port, the stem having a first end and a second end;

a knob at the second end of the stem;

a funnel cup attached to the first end of the stem, the funnel cup slideably contained within the valve body above the stopper;

a downwardly facing conical member on a bottom of the funnel cup;

a plurality of cup holes throughout a body of the funnel cup;

a float cup removably affixed over the knob at the second end of the stem, the float cup slideably contained within the valve body below the stopper;

an upwardly facing conical member on a top of the float cup.

2. The apparatus in claim 1 further comprising the threaded nipple exiting the bottom of the holding tank;

the float valve assembly removably affixed to the threaded nipple.

3. The apparatus in claim 2 further comprising a sealing flange on an upper end of the threaded nipple.

4. The apparatus in claim 1 wherein the holding tank lid is hinged.

5. The apparatus in claim 2 wherein the holding tank lid is hinged.

6. The apparatus in claim 3 wherein the holding tank lid is hinged.

* * * * *